US008680008B2

(12) United States Patent
Russo et al.

(10) Patent No.: US 8,680,008 B2
(45) Date of Patent: Mar. 25, 2014

(54) CUSTOM DECORATING CONFIGURE-TO-ORDER SYSTEM AND CUSTOM DECORATING PROCESS

(75) Inventors: Christopher D. Russo, San Diego, CA (US); Jerry J. Kim, San Diego, CA (US); Jonathan D. Hood, San Marcos, CA (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 2214 days.

(21) Appl. No.: 11/693,413

(22) Filed: Mar. 29, 2007

(65) Prior Publication Data

US 2008/0030937 A1 Feb. 7, 2008

Related U.S. Application Data

(60) Provisional application No. 60/835,305, filed on Aug. 3, 2006.

(51) Int. Cl.
*B41M 5/50* (2006.01)

(52) U.S. Cl.
USPC ..... 503/227

(58) Field of Classification Search
None
See application file for complete search history.

(56) References Cited

U.S. PATENT DOCUMENTS

| | | | | |
|---|---|---|---|---|
| 5,344,808 | A * | 9/1994 | Watanabe et al. | 503/227 |
| 2001/0054861 | A1 | 12/2001 | Pfaff | |
| 2005/0187784 | A1 | 8/2005 | Bander et al. | |
| 2005/0250645 | A1 * | 11/2005 | Ono et al. | 503/227 |
| 2006/0002065 | A1 | 1/2006 | Hua | |
| 2006/0142455 | A1 | 6/2006 | Agarwal et al. | |

OTHER PUBLICATIONS

Internationals Search Report and Written Opinon of the International Searching Authority for PCTUS0774650 mailing date Dec. 18, 2008.
First Office Action from the State Intellectual Property Office of the People's Republic of China for App. No. 2007800369315 issued Aug. 30, 2010.

* cited by examiner

*Primary Examiner* — Bruce H Hess
(74) *Attorney, Agent, or Firm* — Sony Corporation

(57) ABSTRACT

A system for customizing a notebook computer cover is provided. A user station provides a user interface to select at least one image and to transmit the at least one image. A server receives the at least one image from the user station and formats the at least one selected image to fit a shape of the notebook computer cover. A printer prints the at least one image onto a predetermined fabric. A heat chamber heats the notebook computer cover in response to the predetermined fabric being placed on the notebook computer cover to vaporize the image from the predetermined fabric into a clear layer of the notebook computer cover.

3 Claims, 5 Drawing Sheets

CUSTOM DECORATING CONFIGURE-TO-ORDER SYSTEM AND CUSTOM DECORATING PROCESS

RELATED APPLICATION DATA

This application claims priority to provisional application Ser. No. 60/835,305, filed Aug. 3, 2006, the disclosure of which is hereby incorporated by reference herein in its entirety.

FIELD OF THE APPLICATION

The present invention relates generally to a custom decorating configure-to-order system and process.

BACKGROUND

As the demand for customized products grows, the demand for customized mobile electronics is growing. For example, companies sometimes print their corporate logos or other images such as photographs, drawings, computer art, or other digital images, on items given to employees, such as shirts and baseball caps. More and more companies now are now printing their logos on other items used around an office, such as notebook computers. However, adding a corporate logo or design to a notebook computer is expensive and time consuming.

In some current systems, a design such as a logo must often be hand painted onto the cover of a notebook computer. Such hand painting is expensive and the paint has a tendency to wear off or rub off over time, resulting in an unsightly appearance. Moreover, hand painting is especially expensive when the design being added includes complex patterns or a multitude of colors.

According to other currently systems in use, labels or stickers are added to the top or outer edge of the notebook computer cover to display the logo or design. However, such labels or stickers sometimes wear off over time, resulting in an unsightly appearance. Moreover, the stickers or labels are often manually applied, resulting in a slow and expensive overall label or sticker application process.

Accordingly, current systems for adding customized logos or designs to notebook computers are deficient because they are too expensive, the logos or designs are applied in a faulty manner, and the process is very time-intensive.

SUMMARY

At least one embodiment of the invention is directed to a system for customizing a notebook computer cover. A user station and/or website provides a user interface to select at least one image and to transmit the at least one image. A server receives the at least one image from the user station and formats the at least one selected image to fit a shape of the notebook computer cover. A printer prints the at least one image onto a predetermined fabric. A heat chamber heats the notebook computer cover in response to the predetermined fabric being placed on the notebook computer cover to vaporize the image from the predetermined fabric into a clear layer of the notebook computer cover.

At least one embodiment of the invention is directed to a method of customizing a notebook computer cover. According to the method, at least one selected image is received from a user. The at least one selected image is printed onto a predetermined fabric. The predetermined fabric is wrapped over the notebook computer cover. The notebook computer cover is heated to vaporize the image from the predetermined fabric into a clear layer of the notebook computer cover.

At least one embodiment of the invention is directed to a customizable notebook computer cover. A base layer forms a bottom portion of the notebook computer cover. A white layer is disposed on top of the base layer. A clear layer is disposed on top of the white layer. The clear layer comprises an image formed therein of a sublimable ink. The image is selected by a user.

The above summary of the present invention is not intended to represent each embodiment or every aspect of the present invention. The detailed description and Figures will describe many of the embodiments and aspects of the present invention.

BRIEF DESCRIPTION OF THE DRAWINGS

The above and other aspects, features and advantages of the present embodiments will be more apparent from the following more particular description thereof, presented in conjunction with the following drawings wherein.

Figure 1:
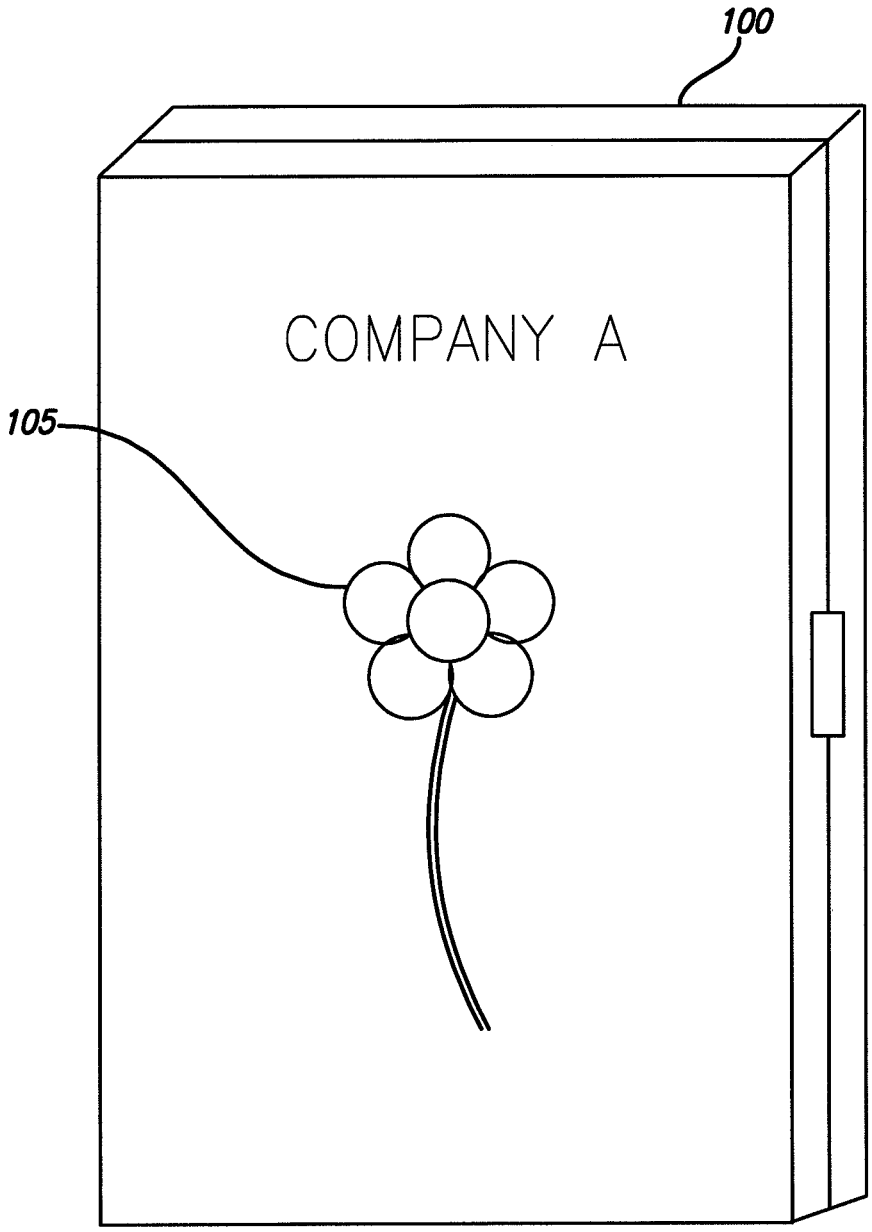
FIG. 1 illustrates a notebook computer having a selected artistic image according to an embodiment of the invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

Embodiments of the present invention are directed to a method of utilizing a dye sublimation process to add customized graphical design images to notebook computer covers. Dye sublimation is a printing process that uses heat to transfer dye to a medium such as a layer of a notebook computer cover. The images are embedded within the top layer of the notebook computer cover during the dye sublimation process, instead of simply on top of the notebook computer cover, as has been done according to current systems.

A user initially selects an image, or multiple images, to add to a notebook computer cover. The image may be user-configurable or selectable such as, for example, a static layout of dots on a background customizable to green dots on a white background or white dots on an orange background. The selection may occur at a user station or device, such as a personal computer. The image may be, for example, a corporate logo or some other design to be added to employee notebook computers. The image may be selected from a set of available images already stored on the user station or accessible by the user station via, for example, the Internet. Alternatively, the user may upload an image. In the event that the user is a baseball fan, the user might upload a photograph that the user has previously taken of a baseball game or a picture taken with the user's family. After the image has been selected/uploaded, the image is transmitted to a server. The transmission may occur via the Internet such that the user may transmit the image from a personal computer to a server located far away.

The user may also select multiple images. In some embodiments, the user may add multiple images to a single notebook computer cover. However, in the event that the user is purchasing multiple notebook computers, the user can designate different images to be added to different notebook computer covers.

After the image is transmitted to the server, the image is formatted to the shape of the notebook computer cover. The notebook computer covers onto which the image is to be added are normally not completely flat and therefore usually include contours that are accounted for during the formatting. Moreover, in the event that the image selected by the user is large (or small), the image might need to be shrunk in size (or enlarged) to fit the available space on the notebook computer cover.

After formatting, the image is then transmitted to a printer. The printer is an X-Y plotter capable of printing color images in a manner similar to that of an inkjet printer. The printer prints the image on a special kind of fabric to facilitate the dye sublimation process.

The notebook computer cover is prepared prior to adding the image via dye sublimation. The notebook computer cover is formed of several layers of material. A base layer may be magnesium or any other suitable material such as a high temperature material. When the notebook computer is in a closed position, the base layer is the bottom layer of the notebook computer cover. The base layer is cleaned and treated with acetone and alcohol, or a phosphate wash, and then a white resin material is applied to the base layer. Alternatively, a resin of a neutral color may instead be used. The white resin material may be spray painted onto the base layer. The notebook computer cover with the white resin material is then heated and allowed to cool. During the heating and cooling, the white resin material adheres to the base layer, forming a white layer. A clear resin material is subsequently applied to the white layer. The clear resin material may be spray painted onto the white layer. The notebook computer cover with the clear resin material is then heated and allowed to cool. During the heating and cooling, the clear resin material adheres to the white layer, forming a clear layer.

The fabric with the printed image is wrapped around the notebook computer cover after the notebook computer cover has been treated. The fabric may be taped onto the notebook computer cover to ensure that the fabric lays flat and snugly on the notebook computer cover. The dye sublimation subsequently occurs, during which the notebook computer cover with the wrapped fabric is heated for a designated amount of time and to a predetermined temperature and then allowed to cool. During the heating, the dye color pattern printed on the fabric vaporizes and the vapors enter into the clear layer. Upon cooling, it can be observed that the image from the fabric is now on the notebook computer cover within the clear layer, instead of residing on the surface of the notebook computer cover, as is done according to current systems.

This process is customizable and allows a user to designate an image to be printed onto one or many notebook computer covers. The various steps involved in treating the notebook computer cover and implementing the dye sublimation process may be implemented as batch processes whereby the same steps are implemented for several notebook computer covers at that same time, as opposed to doing this individually for each notebook computer cover as is done according to some current systems.

FIG. 1 illustrates a notebook computer 100 having an imprinted artistic image 105 according to an embodiment of the invention. The notebook computer 100 normally is mass produced and sold without this artistic image 105. However, in this example, the artistic image 105 was selected by a user and was added to the cover of the notebook computer 100 via a process described below with respect to FIGS. 3-5. The artistic image 105 is not merely drawn on the outside edge of the cover of the notebook computer 100. Instead, the artistic image 105 is disposed within a layer of the cover of the notebook computer 100, providing durability advantages over current methods which are prone to being worn down.

Figure 2:
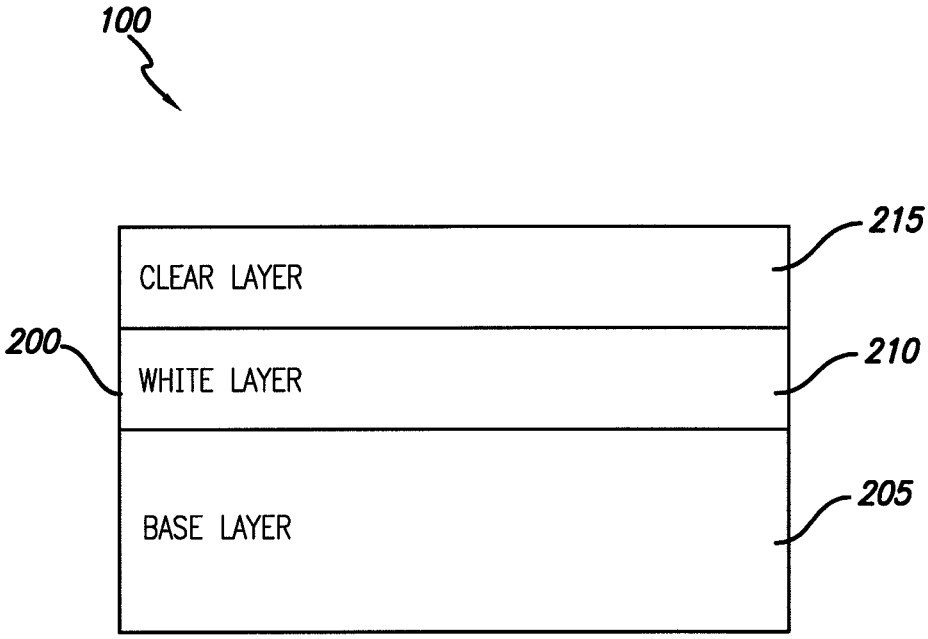
FIG. 2 illustrates a cross sectional view of a cover of the notebook computer according to an embodiment of the invention.

FIG. 2 illustrates a cross sectional view of a notebook computer cover 200 of the notebook computer 100 according to an embodiment of the invention. The notebook computer cover 200 is formed of several layers of material. At the bottom is a base layer 205. The base layer 205 is generally formed of magnesium, although other materials may be suitable according to other embodiments such as another high temperature material. Above the base layer 205 is a white layer 210. The white layer 210 is formed of a white resin that may be spray painted onto the base layer 205. The white layer 210 may include adhesive properties to stick to/bond with the base layer 205. Finally, a clear layer 215 is located above the white layer 210. The clear layer 215 is formed of a clear resin that may be spray painted onto the white layer 210. The clear layer 215 may include adhesive properties to stick to/bond with the white layer 210.

Figure 3:
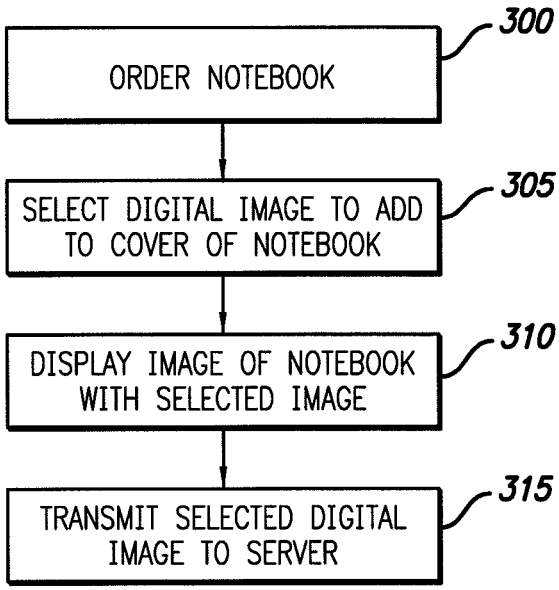
FIG. 3 illustrates a method for ordering an image for a notebook computer cover according to at least one embodiment of the invention.

FIG. 3 illustrates a method for ordering an image for a notebook computer cover 200 according to at least one embodiment of the invention. First, at operation 300, a user orders a notebook computer 100. This ordering may occur via use of an online website or in any other suitable manner, such as during a telephone call to the appropriate ordering department. Next, an image is selected to add to the notebook computer cover 200 at operation 305. As discussed above, the selection may occur at a user station, such as a personal computer. The image may be, for example, a corporate logo to be added to employee notebook computer covers. The image may be selected from a set of available images already stored on the user station or accessible by the user station via, for example, the Internet. Alternatively, the user may upload an image such as a photograph of a baseball game or a picture taken with the user's family. The user may also select multiple images. In some embodiments, the user may add multiple images to a single notebook computer cover 200. However, in the event that the user is purchasing multiple notebook computers, the user can designate different images to be added to different notebook computer covers.

An image of the notebook computer cover 200 with the selected image is shown to the user at operation 310. For example, in the event that the user selects the image to be added to the notebook computer cover 200 online, it is desirable that the user see what the finished notebook computer cover 200 will look like after the image has been added. The selected digital image is subsequently transmitted to a server at operation 315. At this point, the user's interactions in selecting the image are complete.

Figure 4:
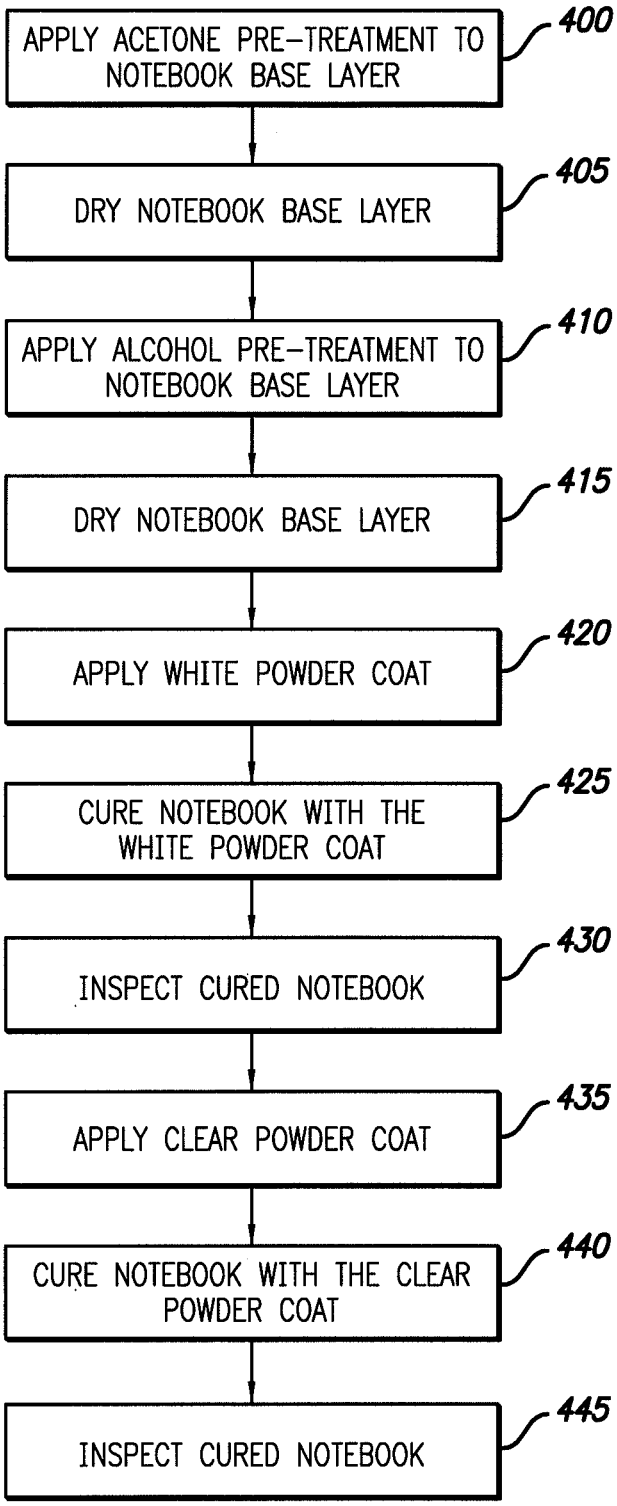
FIG. 4 illustrates the preparation of the notebook computer cover prior to adding the image according to an embodiment of the invention.

FIG. 4 illustrates the preparation of the notebook computer cover 200 prior to adding the image according to an embodiment of the invention. The process shown in FIG. 4 illustrates the operations that take place from the time the notebook computer cover 200 is formed solely of the base layer 205 shown in FIG. 2 until the point at which the white layer 210 and clear layer 215 have been applied to form the multi-layer notebook computer cover 200.

The notebook computer cover 200 is initially placed on a table and covered with tape to mask parts of the notebook computer cover 200 onto which the image will not be applied. It should be appreciated that the act of placing the notebook computer cover 200 on the table is not required in all embodiments. A hook may be taped onto the notebook computer cover 200 or attached to it. The hook is utilized to hang the notebook computer cover 200 when being cleaned and while various layers are applied to the base layer 205 of the notebook computer cover 200. In some embodiments, an apparatus or system other than a hook may be utilized to hold the notebook computer cover 200 in place.

First, an acetone pre-treatment, or some other substantially equivalent pre-treatment such as a phosphate wash, is applied to the notebook computer cover 200 base layer 205 at operation 400. The base layer 205 is subsequently dried with a sensitive soft cloth at operation 405. Next, an alcohol pre-treatment, or some other substantially equivalent pre-treatment, is applied to the base layer 205 at operation 410. The base layer 205 is again subsequently dried with a sensitive soft cloth at operation 415. The acetone and alcohol pre-treatments are applied to clean the base layer 205. The alcohol pre-treatment may contain 70% alcohol and may be dried with a high pressure air spray in addition to the sensitive soft cloth.

Next, a white powder resin coat is applied to the base layer 205 at operation 420. The white powder resin coat may be applied with a hose and spraying mechanism to ensure that the white powder resin coat is applied evenly onto the base layer 205. The notebook computer cover 200 is subsequently hung by the hook onto a cart and placed into a heating chamber or furnace to cure the notebook computer cover 200 with the white powder coat at operation 425. The curing process may be performed at a temperature of about 400° F. for about 12 minutes. In other embodiments, the temperature and length of time for curing may be different. During the curing, the white powder resin coat forms the white layer 210 on top of the base layer 205. After cooling, the notebook computer cover 200 is inspected at operation 430. During the inspection, an inspector looks for irregularities in the notebook computer cover 200 and the white layer 210 such as dimples, bubbles, peeling, craters, specks of dust, color inconsistency, and missing dye spots. In the event that the inspector determines that the curing process was successful, a clear powder resin coat is applied at operation 435. As with the white powder resin, the clear powder resin coat may be applied with a hose and spraying mechanism to ensure that the clear powder resin coat is applied evenly onto the white layer 210. After application, the notebook computer cover 200 is cured at operation 440. The curing process may be performed at a temperature of about 400° F. for about 18 minutes. In other embodiments, the temperature and length of time for curing may be different. During the curing, the clear powder resin coat forms the clear layer 215 on the white layer 210. After cooling, the notebook computer cover 200 is inspected at operation 445.

After the process shown in FIG. 4 is completed, the notebook computer cover 200 is ready for the image selected by the user in the process shown in FIG. 3 to be applied to it. The image is printed onto a fabric and then the image on the fabric is vaporized during a process called dye sublimation. During dye sublimation, the vaporized ink on the fabric forming of the image is absorbed or travels into the clear layer 215 of the notebook computer cover 200, its final resting spot.

Figure 5:
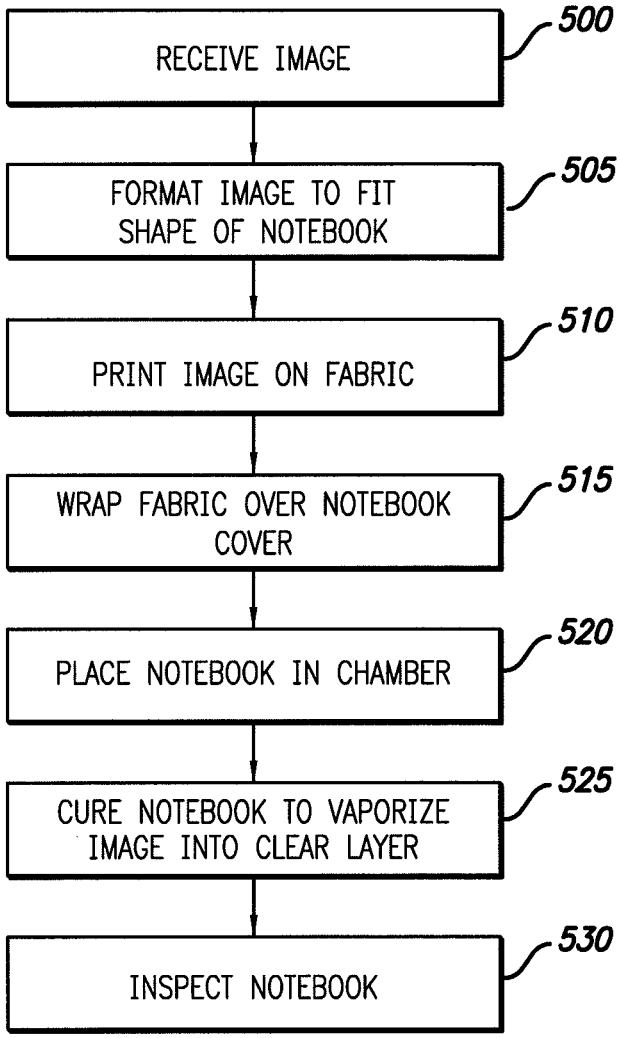
FIG. 5 illustrates a method of adding an image selected by a user to a notebook computer cover according to at least one embodiment of the invention.

FIG. 5 illustrates a method of adding an image selected by the user to a notebook computer cover 200 according to at least one embodiment of the invention. First, at operation 500, the image is received at the server. The image is received from the user station or personal computer, as described above with respect to FIG. 3. Next, at operation 505, the image is formatted to fit the shape of the notebook computer cover 200. In the event that the notebook computer cover 200 has a contour or is not flat in any other way, the image may need to be modified. Moreover, in the event that the image selected by the user is large (or small), the image might need to be shrunk in size (or enlarged) to fit the available space on the notebook computer cover 200. Next, the formatted image is printed on a fabric material at operation 510. The ink used in the printing is of a type that can be vaporized when subjected to a certain temperature. The fabric is subsequently wrapped around the notebook computer cover 200 at operation 515. The wrapping may be performed manually and the person doing the wrapping checks the orientation of the fabric to ensure that the image is properly aligned with the notebook computer cover 200. A coated cover may be placed on top of the fabric when the fabric is wrapped around the notebook computer cover 200. Tape is also placed on the coated cover and fabric to ensure that the fabric remains flat and in proper alignment when placed on the notebook computer cover 200. A plastic material may be place over the cover and the air may be suck out of the plastic cover to ensure a tight fit during the wrapping process.

The notebook computer cover 200 is then placed into the heating chamber or furnace at operation 520. Next, at operation 525, the notebook computer cover 200 is cured to vaporize the image from the fabric into the clear layer 215 of the notebook computer cover 200. During the curing process, the notebook computer cover 200 may be heated to a temperature of 375° F. for about 10 minutes. A different temperature and/or length of time may be utilized according to other embodiments. Finally, at operation 530 the notebook computer cover 200 is inspect to ensure that the curing process effectively and smoothly vaporized the image into the clear layer 215.

Figure 6:
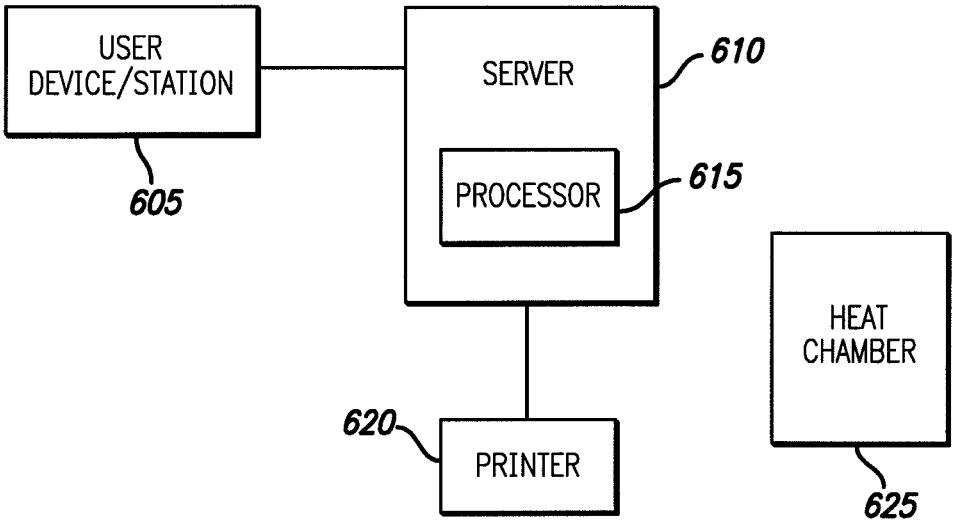
FIG. 6 illustrates a system for preparing the fabric with an image selected by a user according to an embodiment of the invention.

FIG. 6 illustrates a system 600 for preparing the fabric with an image selected by the user according to an embodiment of the invention. The user may select the image from a user device 605. The user device 605 may be a user station such as a personal computer accessible by the user. The user device 605 includes a user interface. After the image (or images) is selected, it is transferred to the server 610. The server 610 may include a processor 615. The processor 615 formats the image and transfers the formatted image to a printer 620. The printer 620 is an X-Y plotter and prints the image onto the fabric. Alternatively, the printer 620 may be some other type of device capable of printing onto the fabric. As discussed above, the ink used by the printer 620 is a dye sublimable ink. The fabric is subsequently wrapped around the notebook computer cover 200 and placed into a heat chamber for curing.

Figure 7:
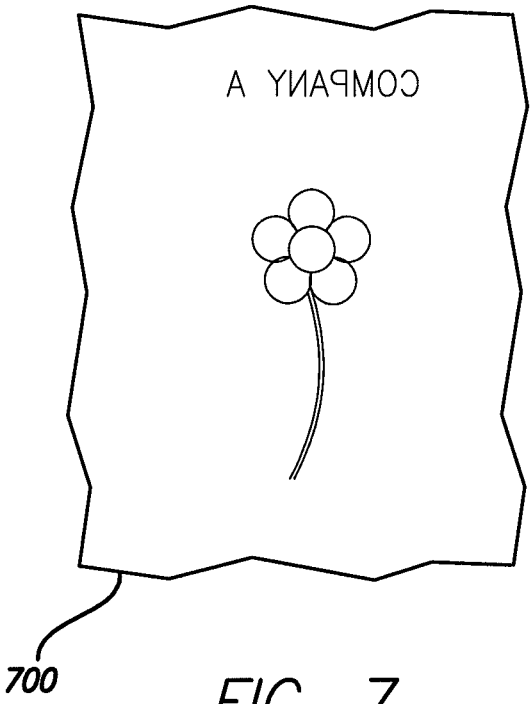
FIG. 7 illustrates a fabric on which the image selected by a user is printed according to an embodiment of the invention.

FIG. 7 illustrates a fabric 700 on which an image selected by the user is printed according to an embodiment of the invention. A mirror image of the image selected by the user is printed on the fabric 700. The fabric 700 is flipped over when wrapped around the notebook computer cover 200 such that the side of the fabric 700 with the ink faces the notebook computer cover 200. When the curing process discussed above with respect to FIG. 5 is successfully completed, the notebook computer cover 200 looks like the notebook computer 100 shown in FIG. 1 with the image imprinted in the clear layer 215.

The teachings discussed herein are generally described with respect to a single image added to a single notebook computer cover 200. However, a person of skill in the art would readily appreciate that these teachings are scalable such that multiple images can be selected and added to a single notebook computer cover or multiple notebook computer covers. Moreover, the same image, or different images can be added to a plurality of different notebook computer covers. The application of the white resin and the clear resin materials may be applied to multiple notebook computer covers at the same time. The curing processes discussed above may also be applied to multiple notebook computer covers at the same time.

According to teachings discussed herein, the user initially selects an image, or multiple images, to add to a notebook computer cover 200. The image may be, for example, a corporate logo to be added to employee notebook computers. The image may be selected from a set of available images already stored on the user station or accessible by the user station via, for example, the Internet or may be uploaded by the user. After the image has been selected/uploaded, the image is transmitted to a server.

After the image is transmitted to the server, the image is formatted to the shape of the notebook computer cover 200. After formatting, the image is then transmitted to a printer. The printer is an X-Y plotter capable of printing color images in a manner similar to that of an inkjet printer. The printer prints the image on a special kind of fabric to facilitate the dye sublimation process.

The notebook computer cover 200 is prepared prior to adding the image via dye sublimation. The notebook computer cover 200 is formed of several layers of material. The base layer may be magnesium or any other suitable material such as another high temperature material. The base layer is cleaned and treated with acetone and alcohol, or a phosphate wash, and then a white resin material is applied to the base layer. Alternatively, a neutral-color resin may instead be utilized. The notebook computer cover 200 with the white resin material is then heated and allowed to cool to form a white layer. A clear resin material is subsequently applied to the white layer. The notebook computer cover 200 with the clear resin material is then heated and allowed to cool to form the clear layer.

The fabric with the printed image is wrapped around the notebook computer cover 200 after the notebook computer cover 200 has been treated. The notebook computer cover 200 with the wrapped fabric is then heated for a designated amount of time and to a predetermined temperature and then allowed to cool. During the heating, the dye color pattern printed on the fabric vaporizes and the vapors enter into the clear layer. Upon cooling, it is observed that the image from the fabric is now on the notebook computer cover 200 within the clear layer, instead of residing on the surface of the notebook computer cover 200, as is done according to current systems.

This process is customizable and allows a user to designate an image to be printed onto one or many notebook computer covers. The various steps involved in treating the notebook computer cover 200 and implementing the dye sublimation process may be implemented as batch processes whereby the same steps are implements for several notebook computer covers at that same time, as opposed to doing this individually for each notebook computer cover 200 as is done according to some current systems.

This invention has been described in detail with reference to various embodiments. Not all features are required of all embodiments. It should also be appreciated that the specific embodiments described are merely illustrative of the principles underlying the inventive concept. It is therefore contemplated that various modifications of the disclosed embodiments will, without departing from the spirit and scope of the invention, be apparent to persons of ordinary skill in the art. Numerous modifications and variations could be made thereto by those skilled in the art without departing from the scope of the invention set forth in the claims.

What is claimed is:

1. A customizable notebook computer cover, comprising:

a base layer forming a bottom portion of the notebook computer cover, wherein the base layer is formed of a high temperature material comprising magnesium;

a white layer disposed on top of the base layer;

a clear layer disposed on top of the white layer, wherein the clear layer comprises an image formed therein of a sublimable ink, the image being selected by a user.

2. The customizable notebook computer cover of claim 1, wherein the white layer is formed of at least one of a cured white resin and a cured neutral color resin.

3. The customizable notebook computer cover of claim 1, wherein the clear layer is formed of a cured clear resin.

* * * * *